US008444242B2

(12) United States Patent
Hyakudome et al.

(10) Patent No.: US 8,444,242 B2
(45) Date of Patent: May 21, 2013

(54) INK REFILLING DEVICE

(75) Inventors: Takao Hyakudome, Nagoya (JP); Goro Okada, Nagoya (JP); Akira Nishio, Kiyosu (JP); Tomoyuki Fujita, Tajimi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 293 days.

(21) Appl. No.: 12/889,862

(22) Filed: Sep. 24, 2010

(65) Prior Publication Data

US 2011/0074842 A1 Mar. 31, 2011

(30) Foreign Application Priority Data

Sep. 29, 2009 (JP) ..... 2009-225330

(51) Int. Cl.
*B41J 2/195* (2006.01)
*B41J 2/175* (2006.01)

(52) U.S. Cl.
USPC ..... 347/7; 347/85

(58) Field of Classification Search
None
See application file for complete search history.

(56) References Cited

U.S. PATENT DOCUMENTS

| | | | | |
|---|---|---|---|---|
| 5,289,654 | A | 3/1994 | Denny et al. | |
| 5,479,968 | A | 1/1996 | Sanchez et al. | |
| 5,950,403 | A | 9/1999 | Yamaguchi et al. | |
| 6,155,664 | A * | 12/2000 | Cook | 347/7 |
| 6,224,199 | B1 | 5/2001 | Yamaguchi et al. | |
| 6,224,201 | B1 * | 5/2001 | Shigemura | 347/93 |
| 7,393,089 | B2 * | 7/2008 | Yamaguchi et al. | 347/85 |
| 2001/0052370 | A1 | 12/2001 | Shinada et al. | |
| 2003/0107626 | A1 | 6/2003 | Qingguo et al. | |
| 2004/0046841 | A1 | 3/2004 | Cheok | |
| 2004/0257409 | A1 | 12/2004 | Cheok | |

FOREIGN PATENT DOCUMENTS

| | | | |
|---|---|---|---|
| CN | 1720143 | A | 1/2006 |
| EP | 0 639 501 | A1 | 2/1995 |
| EP | 2 033 792 | A2 | 3/2009 |
| EP | 2 127 886 | A1 | 12/2009 |
| JP | B2-3666601 | | 6/2005 |
| WO | WO 02/28654 | A1 | 4/2002 |

OTHER PUBLICATIONS

Search Report issued in European Patent Application No. 10179023.6 dated Nov. 5, 2010.

Nov. 28, 2012 Office Action issued in Chinese Patent Application No. 201010507906.4 (with English Translation).

* cited by examiner

*Primary Examiner* — Geoffrey Mruk
(74) *Attorney, Agent, or Firm* — Oliff & Berridge, PLC

(57) ABSTRACT

An ink refilling device including a supply portion to be connected to an ink cartridge and supply ink, an ink tank, a first connecting tube having one end connected to the ink tank, a three-way switching valve including an input end connected to the other end of the first connecting tube, a first output end and a second output end, and adapted to switch between a first flow path from the input end to the first output end and a second flow path from the input end to the second output end, a second connecting tube having one end connected to the first output end and the other end connected to the supply portion, a third connecting tube having one end connected to the second output end and the other end connected to the ink tank, and a feed pump provided along the first connecting tube to feed the ink.

7 Claims, 12 Drawing Sheets

INK REFILLING DEVICE

CROSS-REFERENCE TO RELATED APPLICATION

This application claims priority to Japanese Patent Application No. 2009-225330, filed Sep. 29, 2009, the disclosure of which is hereby incorporated by reference in its entirety.

BACKGROUND

The present disclosure relates to an ink refilling device that refills an ink cartridge for a printing device with ink.

An inkjet printer is known that performs printing by discharging ink onto a print medium such as a paper, a T-shirt, or the like. An ink cartridge that contains ink can be installed in and removed from the inkjet printer. The ink cartridge supplies the ink to a recording head of the printer.

Ordinarily, an operator discards the ink cartridge when the ink has been used up. However, from an environmental standpoint, it would be desirable to refill and reuse the ink cartridge. For example, a method is known that includes three processes. The first process is a process in which an ink injection needle is inserted into an ink supply opening in an ink pouch, and the ink pouch is placed on a base. The second process is an ink discharge process in which, as the ink pouch is compressed using a pressure plate, the ink that remains in the ink pouch is discharged by suction from the ink supply opening. The third process is an ink injection process in which a prescribed amount of the ink is injected into the ink pouch from the ink supply opening.

SUMMARY

In the ink refilling method that is described above, the ink that refills the ink cartridge is stored in an ink tank that has a larger capacity than that of the ink cartridge. In some cases, the ink contains an ink pigment with a high specific gravity, such as titanium oxide. The ink pigment with the high specific gravity may settle out of the ink in the ink tank. If the ink pigment settles out, the concentration and the dispersion of the ink pigment within the ink with which the ink cartridge is refilled from the ink tank are not stable.

Various exemplary embodiments of the general principles herein provide an ink refilling device that is capable of refilling an ink cartridge with ink in which a concentration and a distribution of an ink pigment are stable.

Exemplary embodiments provide an ink refilling device for refilling an ink cartridge of an inkjet printer with ink. The ink refilling device includes a supply portion, an ink tank, a first connecting tube, a three-way switching valve, a second connecting tube, a third connecting tube, and a feed pump. The supply portion is adapted to be connected to the ink cartridge and supply the ink to the ink cartridge when the ink cartridge is refilled with the ink. The ink tank is adapted to store the ink. One end of the first connecting tube is connected to the ink tank. The three-way switching valve includes an input end, a first output end and a second output end, and is adapted to switch between a first flow path and a second flow path. The input end is connected to the other end of the first connecting tube that is at an opposite end of the first connecting tube from the one end. The first flow path runs from the input end to the first output end, and the second flow path runs from the input end to the second output end. One end of the second connecting tube is connected to the first output end of the three-way switching valve and the other end of the second connecting tube is connected to the supply portion. One end of the third connecting tube is connected to the second output end of the three-way switching valve and the other end of the third connecting tube is connected to the ink tank. The feed pump is provided along the first connecting tube and is adapted to feed the ink from inside the ink tank to the input end of the three-way switching valve.

BRIEF DESCRIPTION OF THE DRAWINGS

Exemplary embodiments of the present disclosure will be described below in detail with reference to the accompanying drawings in which.

DETAILED DESCRIPTION

Figure 1:
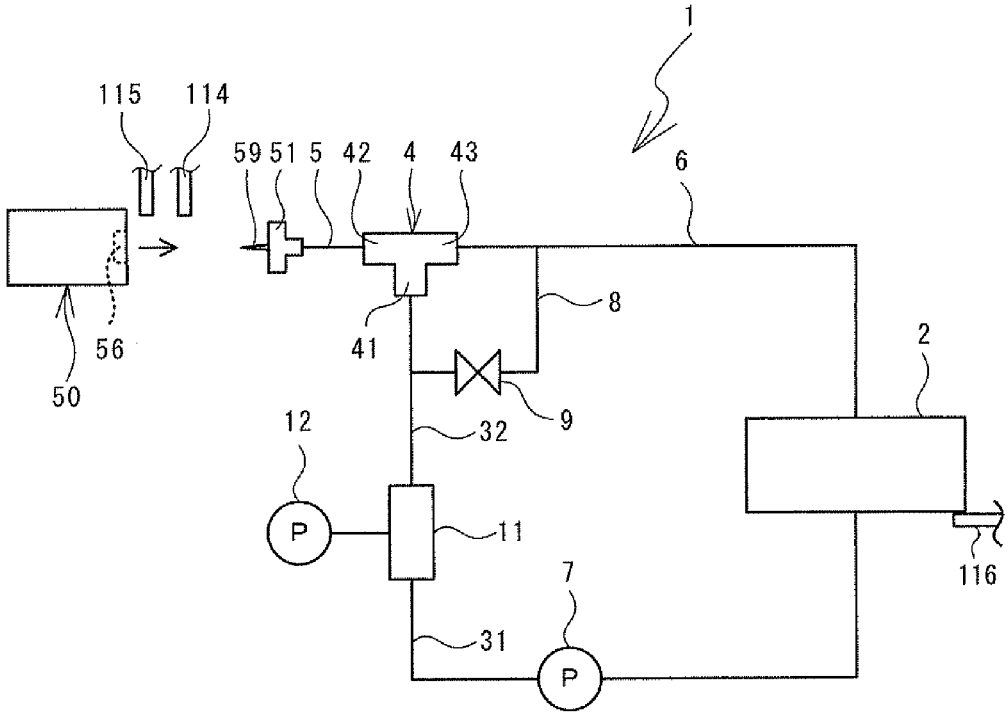
FIG. 1 is a configuration diagram of an ink refilling device 1.

Hereinafter, an ink refilling device 1 according to an embodiment of the present invention will be explained with reference to the drawings. The ink refilling device 1 according to the present embodiment refills an ink cartridge 50 of an inkjet printer with ink. The configuration of the ink refilling device 1 will be explained with reference to FIG. 1.

The ink refilling device 1 includes an ink tank 2 that stores the ink. One end of an upstream tube 31 is connected to the ink tank 2. A feed pump 7 is provided along the upstream tube 31. The feed pump 7 causes the ink within the ink tank 2 to flow through the upstream tube 31. The other end of the upstream tube 31 is connected to an inlet of a degassing module 11. The degassing module 11 removes gas that is dissolved in the ink. A pressure reduction pump 12 is connected to the degassing module 11.

One end of a downstream tube 32 is connected to an outlet of the degassing module 11. The other end of the downstream tube 32 is connected to an input end 41 of a three-way switching valve 4. The three-way switching valve 4 includes the input end 41, a first output end 42, and a second output end 43. The three-way switching valve 4 can switch between a first flow path and a second flow path. The first flow path is a flow path running from the input end 41 to the first output end 42. The second flow path is a flow path running from the input end 41 to the second output end 43.

One end of a second connecting tube 5 is connected to the first output end 42 of the three-way switching valve 4. The other end of the second connecting tube 5 is connected to a supply portion 51. The supply portion 51 is adapted to be connected to a plug member 56 of the ink cartridge 50. The supply portion 51 is provided with a hollow lead-out needle 59. The lead-out needle 59 is provided with a hole in a side portion of its tip portion. When the ink is supplied to the ink cartridge 50, the lead-out needle 59 pierces the plug member 56. Having pierced the plug member 56, the lead-out needle 59 supplies the ink to the ink cartridge 50 through its hole.

A cartridge sensor 114 and an ink amount sensor 115 are provided in the vicinity of the supply portion 51. The cartridge sensor 114 is adapted to detect whether the ink cartridge 50 is connected to the supply portion 51. The ink amount sensor 115 is adapted to detect whether an amount of the ink in the ink cartridge 50 is equal to or more than a specified amount (a full amount in the present embodiment).

One end of a third connecting tube 6 is connected to the second output end 43. The other end of the third connecting tube 6 is connected to the ink tank 2.

A bypass tube 8 branches from a central portion of the downstream tube 32 and connects to a central portion of the third connecting tube 6. A pressure control valve 9 is provided closer to one end of the bypass tube 8 that is connected to the downstream tube 32. The pressure control valve 9 opens in a case where a pressure that is not less than a specified pressure is applied from the downstream tube 32 side. When the pressure control valve 9 opens, the bypass tube 8 connects the downstream tube 32 and the third connecting tube 6, and a portion of the ink that is flowing through the downstream tube 32 flows through the bypass tube 8 instead of passing through the three-way switching valve 4.

The ink tank 2 is positioned in an ink tank positioning portion. The ink tank positioning portion is provided with an ink tank sensor 116. The ink tank sensor 116 is a weight sensor. In a case where the weight of the ink tank 2 becomes less than a specified value, the ink tank sensor 116 transmits a detection signal. In other words, the ink tank sensor 116 transmits the detection signal in a case where an amount of the ink that is remaining in the ink tank 2 has become less than a specified amount.

Figure 2:
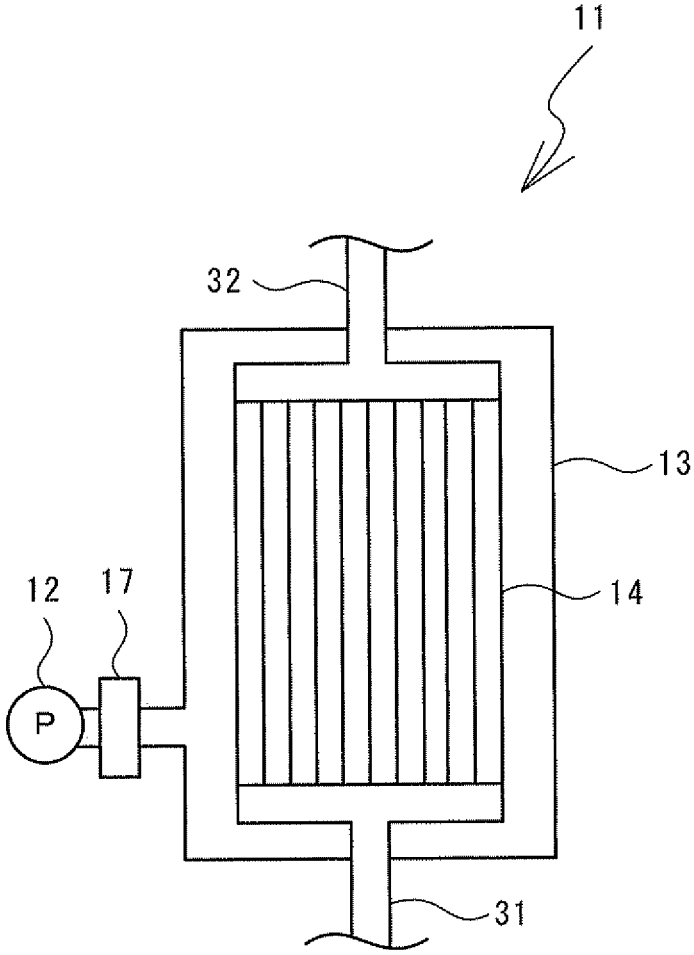
FIG. 2 is a configuration diagram of a degassing module 11.

The degassing module 11 will be explained with reference to FIG. 2. The degassing module 11 includes a cylindrical case 13 and a bundle of a plurality of hollow fibers 14. The case 13 is in a state of being sealed off from an outside air. The case 13 accommodates the hollow fibers 14 in its interior. The ink flows through the interior of each of the hollow fibers 14. One end of each of the hollow fibers 14 is connected to the upstream tube 31, and the other end is connected to the downstream tube 32. The pressure reduction pump 12 is connected to the case 13. The pressure reduction pump 12 reduces the pressure in the interior of the case 13 by suctioning air out of the case 13. The reduction of the pressure generates a pressure difference between the inside and the outside of each of the hollow fibers 14. The pressure difference causes the gas that is dissolved in the ink that is flowing through the interiors of the hollow fibers 14 to move to the outside. In this manner, the degassing module 11 and the pressure reduction pump 12 remove the gas that is dissolved in the ink.

A drain separator 17 is provided between the case 13 and the pressure reduction pump 12. In a case where the ink has leaked from the hollow fibers 14, the drain separator 17 traps the ink before the ink is suctioned into the pressure reduction pump 12.

Figure 3:
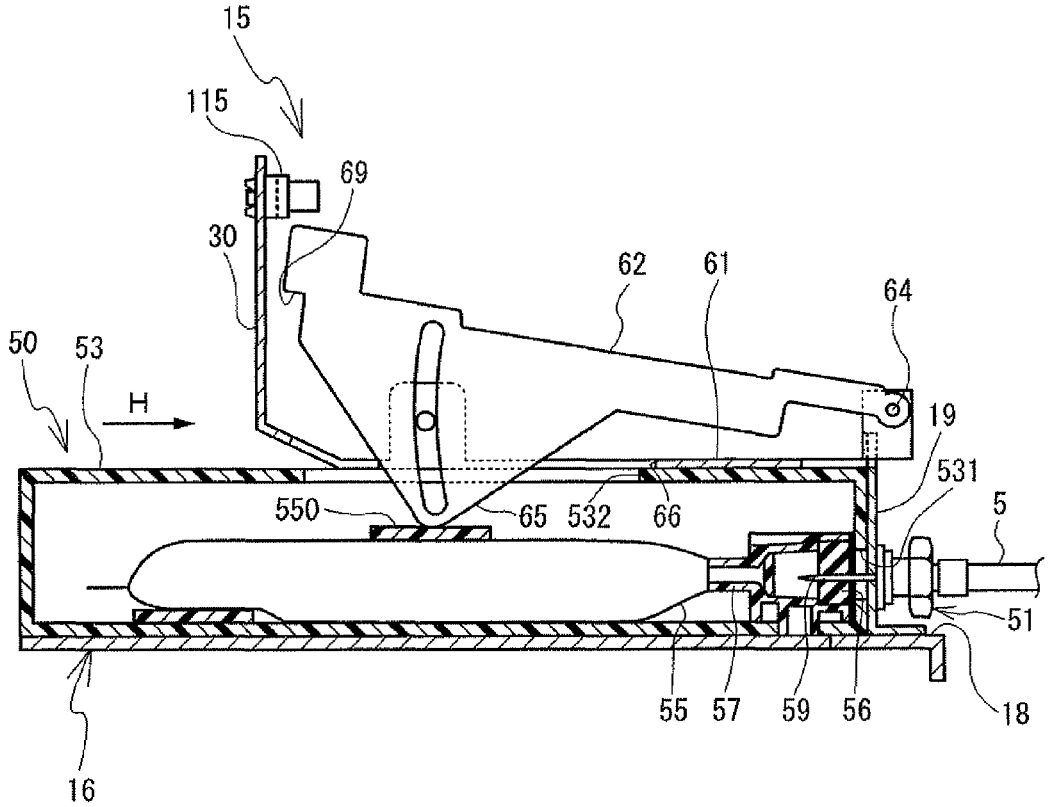
FIG. 3 is a vertically sectioned front view of a cartridge mounting portion 16 in a state in which an ink cartridge 50 is mounted.

The ink cartridge 50 will be explained with reference to FIG. 3. In FIG. 3, the up, down, left, and right directions respectively correspond to the top, bottom, left, and right sides of the ink cartridge 50. As shown in FIG. 3, the ink cartridge 50 includes a roughly rectangular housing 53 and an ink pouch 55. The housing 53 accommodates the ink pouch 55 in its interior. The ink pouch 55 contains the ink. A member 550 is provided on the top face of the ink pouch 55 inside the ink cartridge 50. The ink pouch 55 has an opening portion in its right end portion. A roughly cylindrical opening plug 57 is inserted into the opening portion. The plug member 56, which is made of an elastic material, is inserted into the right end portion of the opening plug 57. The housing 53 has an opening portion 531 in its right side wall. The top wall of the housing 53 has a slit 532 that extends in the left-right direction. The plug member 56 is exposed to the outside of the housing 53 through the opening portion 531. The ink cartridge 50 can be connected to the supply portion 51 when the plug member 56 is pierced by the lead-out needle 59.

A structure by which the ink cartridge 50 is connected to the ink refilling device 1 will be explained with reference to FIG. 3. The ink refilling device 1 is provided with a cartridge mounting portion 16. The cartridge mounting portion 16 is a section where the ink cartridge 50 can be mounted. In FIG. 3, the up, down, left, and right directions respectively correspond to the top, bottom, left, and right sides of the cartridge mounting portion 16. The cartridge mounting portion 16 includes a support platform 18, a contact plate 19, a top plate 61, and a pair of side plates (not shown in the drawings). The ink cartridge 50 can be placed horizontally on the support platform 18. The contact plate 19 extends perpendicularly upward from the right portion of the support platform 18. The right end portion of the ink cartridge 50 may make contact with the contact plate 19. The top plate 61 extends horizontally from the top edge portion of the contact plate 19. The top plate 61 may receive the top face of the ink cartridge 50. The pair of the side plates may guide the two side face portions of the ink cartridge 50. The two side face portions are faces that are opposite one another in the width direction of the ink cartridge 50 (in FIG. 3, the direction from the front surface side of the page to the rear surface side of the page). The lead-out needle 59 protrudes to the left from the contact plate 19.

The cartridge mounting portion 16 is open on the left in FIG. 3. An operator can mount the ink cartridge 50 in the cartridge mounting portion 16 by inserting the ink cartridge 50 in a direction of an arrow H from the opening in the cartridge mounting portion 16. Conversely, the operator can remove the ink cartridge 50 from the cartridge mounting portion 16 by pulling the ink cartridge 50 out in the opposite direction from the direction of the arrow H. When the operator mounts the ink cartridge 50 in the cartridge mounting portion 16, the lead-out needle 59 pierces the plug member 56 of the ink cartridge 50.

A mechanism to detect an amount of the ink contained in the ink cartridge 50 will be explained with reference to FIG. 3. An ink amount detection device 15 is provided in the cartridge mounting portion 16. The ink amount detection device 15 includes the ink amount sensor 115 and a detection lever 62 that is disposed above the top plate 61. A support piece 64 rotatably supports the right end portion of the detection lever 62. The detection lever 62 includes in its left portion a contact piece 65 that is roughly triangular in a front view. The top plate 61 includes a window portion 66. The contact piece 65 can pass through the window portion 66.

A vertical wall 30 extends roughly perpendicularly upward in relation to the top plate 61, from the left portion of the top plate 61. The ink amount sensor 115 is secured to the vertical wall 30. The ink amount sensor 115 may be a transmission-type photointerrupter, for example. The ink amount sensor 115 includes a light emitting element (not shown in the drawings) and a light receiving element (not shown in the drawings). The light receiving element faces the light emitting element such that a movement path of a detection piece portion 69 passes between the light emitting element and the light receiving element.

When the operator mounts the ink cartridge 50 in the cartridge mounting portion 16, the contact piece 65 goes into the slit 532 of the ink cartridge 50. The bottom edge of the contact piece 65 comes into contact with the member 550 on the top face of the ink pouch 55 of the ink cartridge 50. If the amount of the ink inside the ink pouch 55 becomes larger, the height position of the top face of the ink pouch 55 moves upward, and so the contact piece 65 is moved upward. The detection lever 62 rotates around the support piece 64. The detection piece portion 69 is located at the tip of the detection lever 62. In the present embodiment, in a ease where the detection piece portion 69 is not positioned between the light emitting element and the light receiving element, the ink amount sensor 115 detects that the amount of the ink is not the full amount, that is, that the amount of the ink is less than the specified amount. In a case where the detection piece portion 69 is positioned between the light emitting element and the light receiving element, the ink amount sensor 115 detects that the amount of the ink is the full amount, that is, that the amount of the ink is equal to or more than the specified amount.

Figure 4:
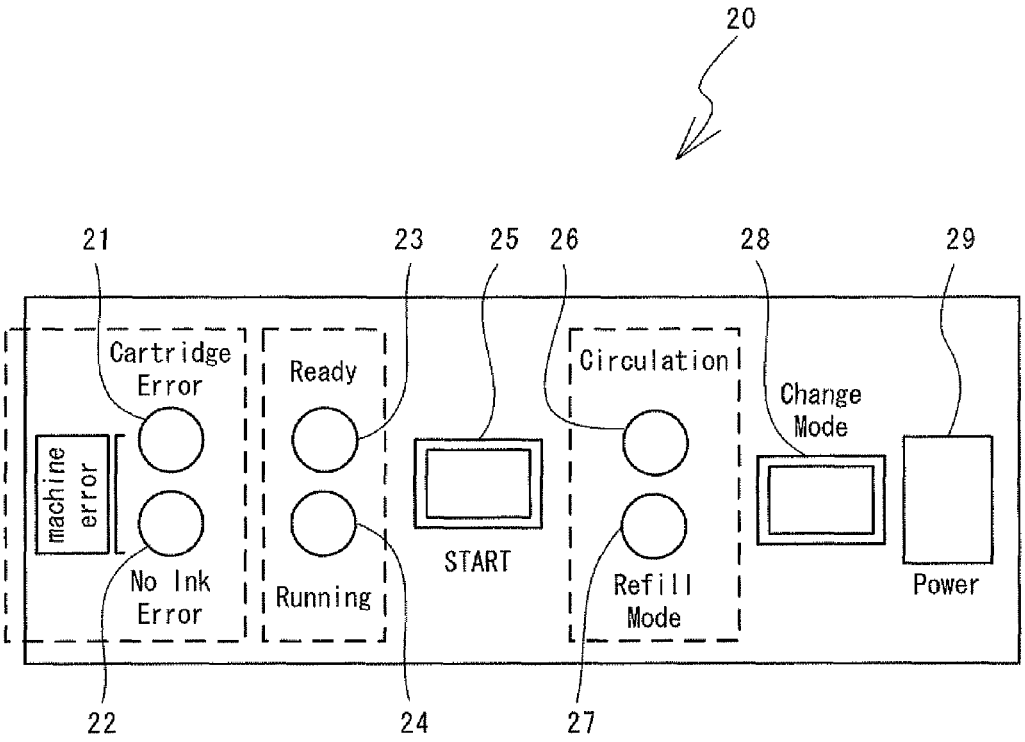
FIG. 4 is a front view of an operation panel 20.

An operation panel 20 of the ink refilling device 1 will be explained with reference to FIG. 4. The ink refilling device 1 is provided with the operation panel 20. The operation panel 20 includes a power button 29, a mode change button 28, and a start button 25. The mode change button 28 is a button for switching between a refill operation and a circulation operation that the ink refilling device 1 performs. The start button 25 is a button for starting the refill operation and the circulation operation, which will be described later.

The operation panel 20 includes a circulation lamp 26, a refill lamp 27, a ready lamp 23, a running lamp 24, and error display lamps 21 and 22. If the operator presses the start button 25 when the refill lamp 27 is in an ON state, the ink refilling device 1 starts the refill operation. The ready lamp 23 turns ON in a case where the amount of the ink inside the ink cartridge 50 that is connected to the supply portion 51 is not less than the specified amount. The running lamp 24 is ON during the refill operation and the circulation operation. The error display lamp 21 turns ON in a case where a command is issued to perform the refill operation when the ink cartridge 50 is not connected to the supply portion 51. The error display lamp 22 turns ON in a case where the amount of the ink inside the ink tank 2 is less than the specified amount.

The operations of the ink refilling device 1 that has the configuration as described above will be explained with reference to FIG. 1. The operations that the ink refilling device 1 can perform include the refill operation and the circulation operation. The refill operation is an operation that, through the upstream tube 31, the downstream tube 32, and the second connecting tube 5, refills the ink cartridge 50 with the ink from inside the ink tank 2. The circulation operation is an operation that circulates the ink through the upstream tube 31, the downstream tube 32, and the third connecting tube 6 and send it back to the ink tank 2.

The refill operation will be explained. In the refill operation, the three-way switching valve 4 forms the first flow path running from the input end 41 to the first output end 42. When the feed pump 7 is operated, the feed pump 7 feeds the ink from inside the ink tank 2 through the upstream tube 31 and the downstream tube 32 to the input end 41 of the three-way switching valve 4. The ink that flows into the input end 41 flows out from the first output end 42, then flows through the second connecting tube 5 and into the ink cartridge 50. If the operator operates the mode change button 28 and the start button 25 of the operation panel 20, the ink refilling device 1 starts the refill operation.

The circulation operation will be explained. In the circulation operation, the three-way switching valve 4 forms the second flow path running from the input end 41 to the second output end 43. When the feed pump 7 is operated, the feed pump 7 feeds the ink from inside the ink tank 2 through the upstream tube 31 and the downstream tube 32 to the input end 41 of the three-way switching valve 4. The ink that flows into the input end 41 flows out from the second output end 43, then flows through the third connecting tube 6 and returns to the ink tank 2. By performing the circulation operation, the ink refilling device 1 can churn the ink that is stored in the ink tank 2. This causes the ink pigment contained in the ink to be dispersed uniformly throughout the ink. After the power supply to the ink refilling device 1 is turned on, the ink refilling device 1 performs the circulation operation every time that a specified time T1 elapses.

Figure 5:
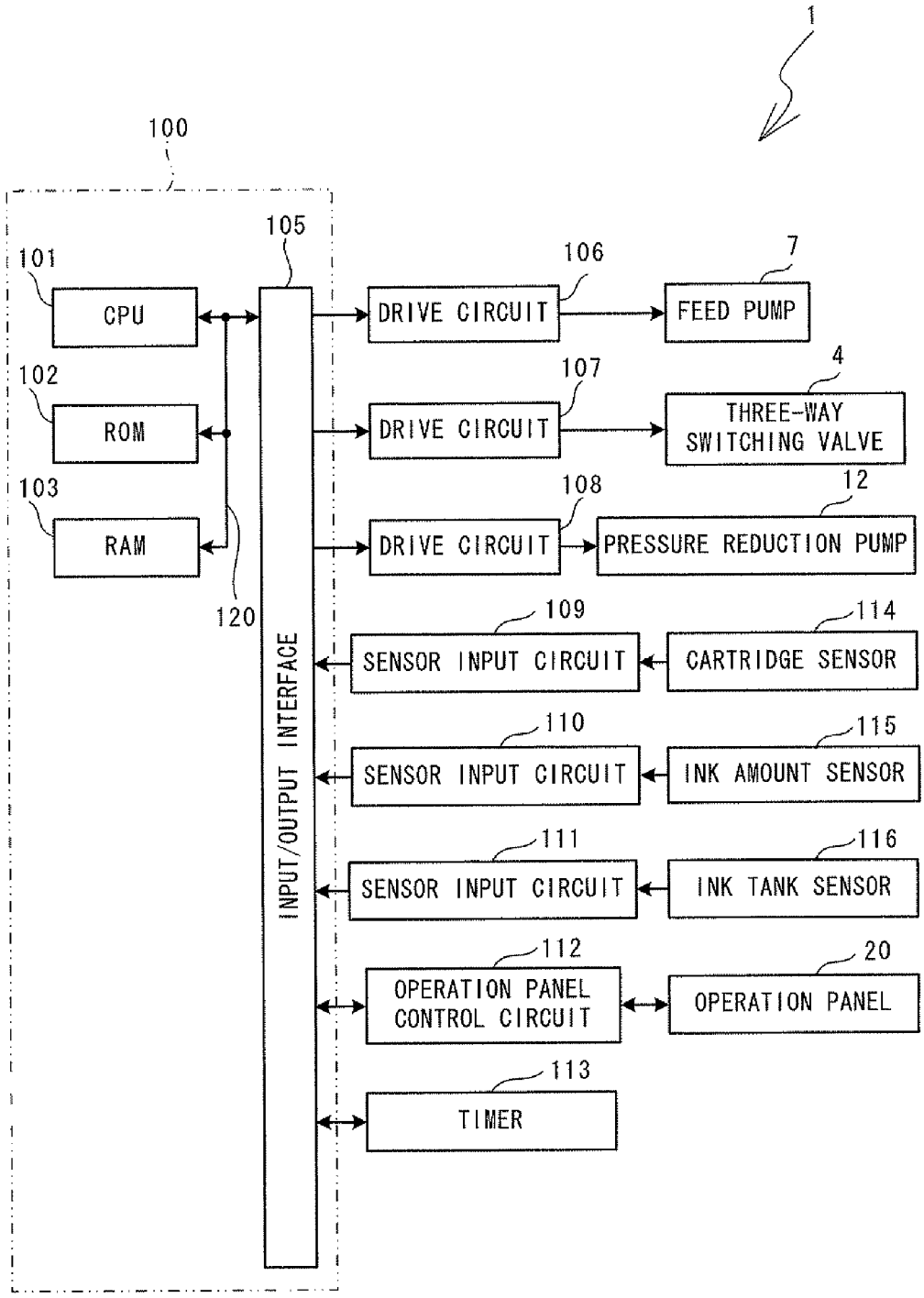
FIG. 5 is a block diagram that shows an electrical configuration of the ink refilling device 1.

The electrical configuration of the ink refilling device 1 will be explained with reference to FIG. 5. The ink refilling device 1 includes a control circuit portion 100 that is formed on a control board. The control circuit portion 100 includes a CPU 101, a ROM 102, a RAM 103, and an input/output interface 105. A bus 120 connects the CPU 101, the ROM 102, the RAM 103, and the input/output interface 105 to one another.

The CPU 101 performs overall control of the ink refilling device 1. The ROM 102 stores various types of control programs and the like that the CPU 101 executes. The RAM 103 stores data temporarily.

A drive circuit 106, a drive circuit 107, and a drive circuit 108 are each connected to the input/output interface 105. The drive circuit 106 drives the feed pump 7. The drive circuit 107 drives a drive portion of the three-way switching valve 4. The drive circuit 108 drives the pressure reduction pump 12.

A sensor input circuit 109, a sensor input circuit 110, and a sensor input circuit 111 are each connected to the input/output interface 105. A detection signal from the cartridge sensor 114 is input to the sensor input circuit 109. A detection signal from the ink amount sensor 115 is input to the sensor input circuit 110. The detection signal from the ink tank sensor 116 is input to the sensor input circuit 111.

An operation panel control circuit 112 and a timer 113 are each connected to the input/output interface 105. The operation panel control circuit 112 accepts an input from the operation panel 20. The operation panel control circuit 112 outputs data to the operation panel 20.

Figure 6:
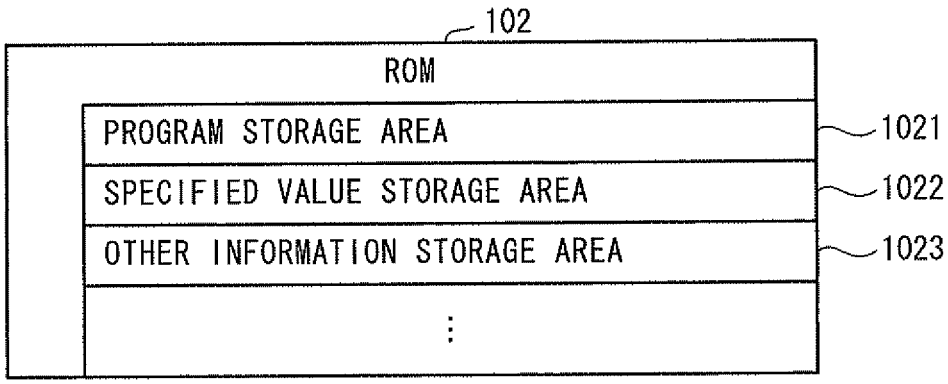
FIG. 6 is a conceptual diagram of storage areas in a ROM 102.

Storage areas in the ROM 102 will be explained with reference to FIG. 6. The storage areas in the ROM 102 include at least a program storage area 1021, a specified value storage area 1022, and an other information storage area 1023. The program storage area 1021 stores various types of programs. The various types of programs include at least an ink refill and circulation program. The specified value storage area 1022 stores specified values that are necessary in order to execute a program.

Figure 7:
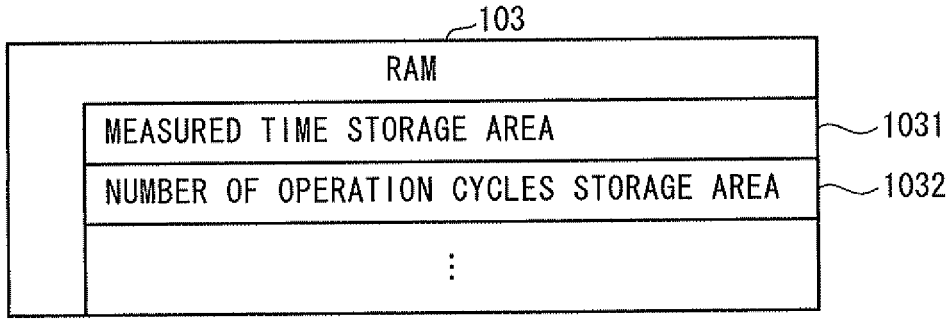
FIG. 7 is a conceptual diagram of storage areas in a RAM 103.

Storage areas in the RAM 103 will be explained with reference to FIG. 7. The storage areas in the RAM 103 include at least a measured time storage area 1031 and a number of operation cycles storage area 1032. The measured time storage area 1031 stores various types of times that have been measured by the timer 113. The measured time storage area 1031 includes a refill information storage area (not shown in the drawings) and a circulation information storage area (not shown in the drawings). The refill information storage area stores a time that has been measured by the timer 113 during the refill processing. The circulation information storage area stores a time that has been measured by the timer 113 during the circulation processing. The number of operation cycles storage area 1032 stores the number of times that the feed pump 7 has been operated during the circulation processing is stored as a number of operation cycles N.

Ink refill and circulation processing that the ink refilling device 1 executes will be explained with reference to FIGS. 8 to 10. When the operator presses the power button 29 on the operation panel 20, the CPU 101 performs the ink refill and circulation processing according to the ink refill and circulation program that is stored in the ROM 102.

The CPU 101 first performs initialization processing (Step S11). Specifically, the CPU 101 sets to zero (0) the various types of measured times that are stored in the measured time storage area 1031 of the RAM 103. The three-way switching valve 4 forms the second flow path running from the input end 41 to the second output end 43. The timer 113 starts to measure the time (Step S13). The CPU 101 stores the time that the timer 113 has measured, as a measured time t1, in the measured time storage area 1031 of the RAM 103. The CPU 101 determines whether a command to perform the refill operation has been received (Step S15). In a case where the operator has operated the mode change button 28 and the start button 25, the CPU 101 determines that the command to perform the refill operation has been received (YES at Step S15). The CPU 101 then performs the refill processing (Step S21).

The refill processing will be explained with reference to FIG. 9. The CPU 101 first performs initialization processing (Step S30). Specifically, the CPU 101 sets to zero (0) the various types of measured times that are stored in the refill information storage area (not shown in the drawings) of the measured time storage area 1031 of the RAM 103. The CPU 101 determines whether the ink cartridge 50 is connected to the supply portion 51 (Step S31). In a case where the cartridge sensor 114 has not detected that the ink cartridge 50 is connected to the supply portion 51 (NO at Step S31), the CPU 101 turns on the error display lamp 21 on the operation panel 20 (Step S59). The CPU 101 then terminates the refill processing.

In a case where it has been detected that the ink cartridge 50 is connected to the supply portion 51 (YES at Step S31), the CPU 101 determines whether the amount of the ink inside the ink cartridge 50 is the full amount (Step S33). In a case where the ink amount sensor 115 has detected that the amount of the ink is the full amount (YES at Step S33), it is not necessary for the ink refilling device 1 to supply more ink to the ink cartridge 50. Therefore, the CPU 101 turns on the ready lamp 23 (Step S61) and terminates the refill processing.

In a case where the ink amount sensor 115 has not detected that the amount of the ink inside the ink cartridge 50 is the full amount (NO at Step S33), it is necessary for the ink refilling device 1 to supply ink to the ink cartridge 50. Therefore, the CPU 101 turns on the running lamp 24. The CPU 101 then causes the pressure reduction pump 12 to operate (Step S35). The pressure reduction pump 12 suctions the air out of the case 13 of the degassing module 11. The suction of the air creates a state of negative pressure outside each of the hollow fibers 14 that are disposed inside the case 13. The gas that is dissolved in the ink in the interior of each of the hollow fibers 14 moves to the outside of each of the hollow fibers 14. By this method, the degassing module 11 and the pressure reduction pump 12 can degas the ink. The timer 113 starts to measure the time. The CPU 101 stores the time that the timer 113 has measured, as a measured time t2, in the measured time storage area 1031 of the RAM 103. The measured time t2 corresponds to an operation time of the pressure reduction pump 12.

The CPU 101 determines whether the measured time t2 has reached a specified time T2 (Step S37). The specified time T2 is stored in the specified value storage area 1022 of the ROM 102. The specified time T2 is the time that is required in order for the pressure reduction pump 12 to sufficiently reduce the pressure in the interior of the case 13. In a case where the measured time t2 has not reached the specified time T2 (NO at Step S37), the pressure in the interior of the case 13 has not decreased sufficiently. The CPU 101 therefore repeats the processing at Step S37.

In a case where the measured time t2 has reached the specified time T2 (YES at Step S37), the pressure in the interior of the case 13 has decreased sufficiently. Accordingly, the CPU 101 causes the feed pump 7 to operate (Step S39). The ink from inside the ink tank 2 flows through the upstream tube 31 and into the degassing module 11. As described previously, the ink flows into the degassing module 11 after the pressure in the interior of the case 13 has decreased sufficiently. The degassing module 11 can therefore reliably remove gas from the ink.

The timer 113 starts to measure the time. The CPU 101 stores the time that the timer 113 has measured, as a measured time t3, in the measured time storage area 1031 of the RAM 103. The measured time t3 corresponds to an operation time of the feed pump 7. The CPU 101 determines whether the measured time t3 has reached a specified time T3 (Step S41). The specified time T3 is stored in the specified value storage area 1022 of the ROM 102. The specified time T3 is the time that is required in order for the ink that is discharged from the degassing module 11 to move from the upstream end to the downstream end of the downstream tube 32. In a case where the measured time t3 has not reached the specified time T3 (NO at Step S41), the ink that has not been degassed is still flowing in the downstream tube 32. The CPU 101 therefore repeats the processing at Step S41.

In a case where the measured time t3 has reached the specified time T3 (YES at Step S41), the gas has been fully removed from the ink that is flowing in the downstream tube 32. In other words, the ink that flows into the input end 41 has been completely degassed. The CPU 101 controls the three-way switching valve 4 through the drive circuit 107. The three-way switching valve 4 switches the flow path from the second flow path to the first flow path (Step S43). This causes the ink that has flowed into the input end 41 to be discharged from the first output end 42. The discharged ink flows through the second connecting tube 5 and the supply portion 51 and into the ink cartridge 50. Thus, the ink refilling device 1 is able to refill the ink cartridge 50 with the completely degassed ink. The timer 113 starts to measure the time. The CPU 101 stores the time that the timer 113 has measured, as a measured time t5, in the measured time storage area 1031 of the RAM 103. The measured time t5 corresponds to an ink refilling time for the ink cartridge 50.

In order to detect a disconnection of the ink cartridge 50 during the refill operation, due to an unforeseen circumstance, the CPU 101 determines whether the ink cartridge 50 is connected to the supply portion 51 (Step S45). In a case where the ink flows into the supply portion 51 while the ink cartridge 50 is not connected to the supply portion 51, the ink will leak to the outside. In a case where the cartridge sensor 114 has not detected that the ink cartridge 50 is connected to the supply portion 51 (NO at Step S45), the CPU 101 turns on the error display lamp 21 of the operation panel 20 (Step S63) and turns off the running lamp 24.

The CPU 101 then causes the feed pump 7 to stop its operation (Step S51). The supplying of the ink to the supply portion 51 stops. The CPU 101 causes the pressure reduction pump 12 to stop its operation (Step S53). The degassing of the ink stops. The three-way switching valve 4 switches the flow path from the first flow path to the second flow path (Step S57). The refill processing is terminated. In a case where the operator removes the ink cartridge 50 from the supply portion 51 while the refill operation is in progress, the ink refilling device 1 stops the refill operation. The ink refilling device 1 is therefore able to prevent a leakage of the ink from the supply portion 51.

In a case where the cartridge sensor 114 has detected that the ink cartridge 50 is connected to the supply portion 51 (YES at Step S45), the CPU 101 determines whether the amount of the ink that is remaining inside the ink tank 2 is equal to or more than a specified amount (Step S47). The ink tank sensor 116 detects the amount of the ink that is remaining inside the ink tank 2. The specified amount is stored in the ROM 102 in advance. In a case where the CPU 101 determines that the remaining amount of the ink is less than the specified amount (NO at Step S47), air may flow into the supply portion 51 instead of the ink. Accordingly, the CPU 101 controls the operation panel 20 through the operation panel control circuit 112. The error display lamp 22 is turned on (Step S65). The running lamp 24 is turned off. The CPU 101 performs the previously described Steps S51 to S57. The refill processing is terminated. In a case where the ink that is remaining inside the ink tank 2 is less than the specified amount, the ink refilling device 1 stops the supplying of the ink to the supply portion 51. The ink refilling device 1 is therefore able to prevent air from entering the ink cartridge 50.

In a case where the CPU 101 determines that the remaining amount of the ink that the ink tank sensor 116 has detected is equal to or more than the specified amount (YES at Step S47), the ink tank 2 contains a sufficient amount of the ink. The ink refilling device 1 is therefore able to supply the ink to the ink cartridge 50 in a stable manner. The CPU 101 determines whether the amount of the ink in contained in the ink cartridge 50 that is connected to the supply portion 51 is the full amount (Step S49).

In a case where the ink amount sensor 115 has not detected that the ink in the ink cartridge 50 is the full amount (NO at Step S49), it is necessary for the ink refilling device 1 to supply the ink to the ink cartridge 50. Accordingly, the CPU 101 determines whether the measured time t5 has reached a specified time T5 (Step S67). As described previously, the measured time t5 is stored in the measured time storage area 1031 of the RAM 103. The specified time T5 is stored in the specified value storage area 1022 of the ROM 102. The specified time T5 is the time that is required in order for the empty ink cartridge 50 to be filled to the full amount. As described previously, the measured time t5 corresponds to the time that has elapsed since the ink refilling device 1 started refilling the ink cartridge 50 with the ink at Step S43 (an ink refilling time).

In a case where the measured time t5 has reached the specified time T5 (YES at Step S67), the amount of the ink inside the ink cartridge 50 has not reached the full amount, even though a sufficient length of time to refill the ink cartridge 50 has elapsed. In this case, a failure may have occurred in some part of the ink refilling device 1. Accordingly, the CPU 101 turns on the error display lamps 21 and 22 on the operation panel 20 (Step S69). The CPU 101 also turns off the running lamp 24. The CPU 101 performs the previously described processing at Steps S51 to S57. The refill processing is terminated. In a case where the measured time 15 has not reached the specified time T5 (NO at Step S67), the CPU 101 returns to the processing at Step S45. The CPU 101 then repeats the processing that is described above. The ink refilling device 1 continues the refilling of the ink cartridge 50 with the ink until the ink refilling time, that is, the measured time t5, reaches the specified time T5.

In a case where the ink amount sensor 115 has detected that the ink inside the ink cartridge 50 is the full amount (YES at Step S49), it is not necessary for the ink refilling device 1 to supply any more of the ink to the ink cartridge 50. The CPU 101 turns off the running lamp 24 on the operation panel 20. The CPU 101 performs the previously described processing at Steps S51 to S57. The refill processing is terminated. In a case where the CPU 101 has determined that the full amount of the ink is stored in the ink cartridge 50, the ink refilling device 1 stops the supplying of the ink to the ink cartridge 50. The ink refilling device 1 is therefore able to supply an appropriate amount of the ink to the ink cartridge 50.

Figure 8:
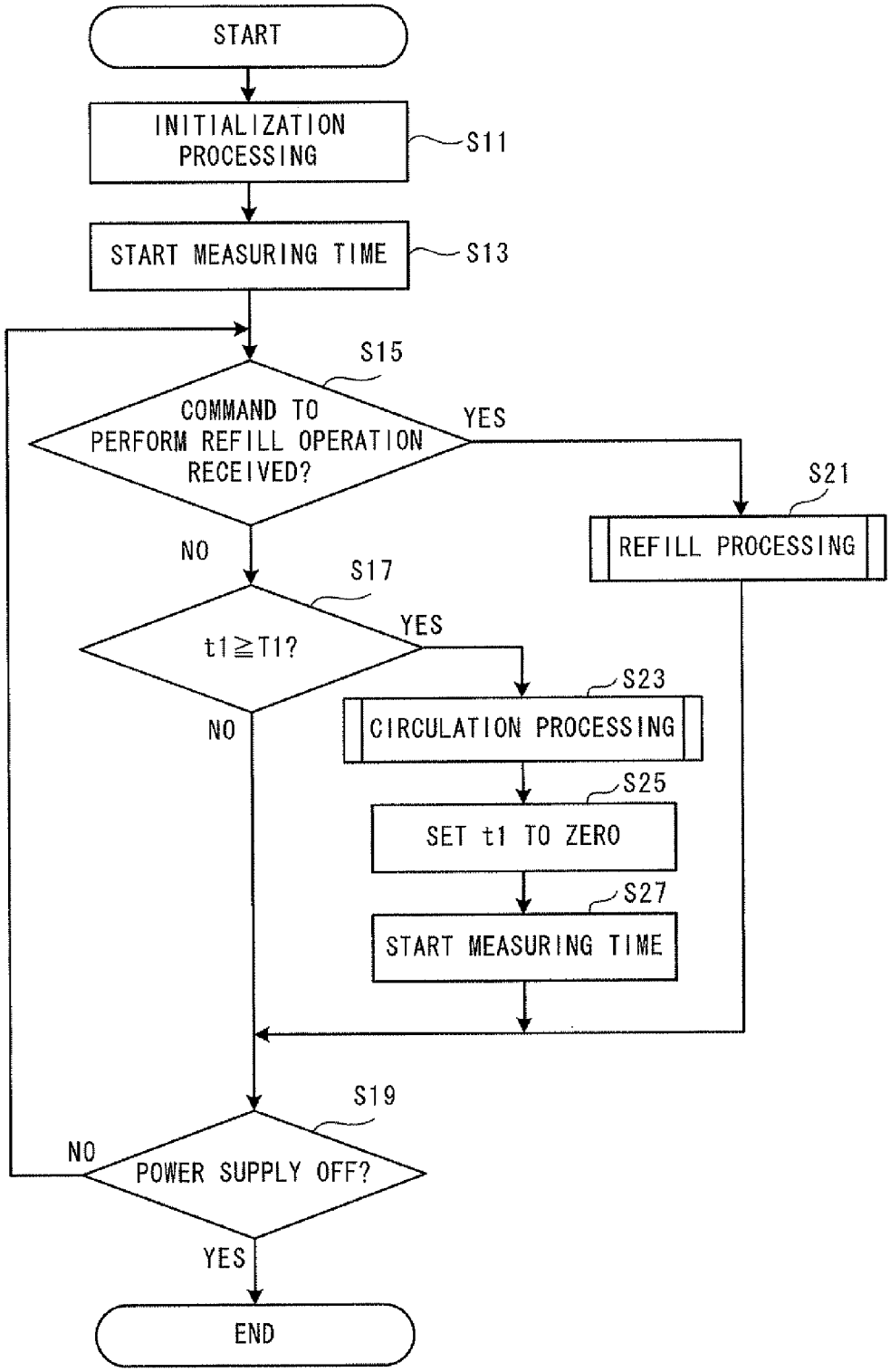
FIG. 8 is a flowchart of ink refill and circulation processing that is performed in the ink refilling device 1.

In the ink refill and circulation processing that is shown in FIG. 8, after the refill processing (Step S21) is terminated, the CPU 101 determines whether the power supply is off (Step S19). If the operator presses the power button 29 on the operation panel 20, the power supply is turned off. In a case where the power supply is off (YES at Step S19), the CPU 101 terminates the ink refill and circulation processing. In a case where the power supply is not off (NO at Step S19), the CPU 101 returns to the processing at Step S15. The CPU 101 then repeats the processing that is described above.

In the ink refill and circulation processing, in a case where the CPU 101 has determined that the command to perform the refill operation has not been received (NO at Step S15), the CPU 101 determines whether the measured time t1 has reached the specified time T1 (Step S17). In a case where the measured time t1 has reached the specified time T1 (YES at Step S17), the CPU 101 performs the circulation processing (Step S23).

The circulation processing will be explained with reference to FIG. 10. In the circulation processing, the CPU 101 first performs initialization processing (Step S80). Specifically, the CPU 101 sets to zero (0) a measured time t6 that is stored in the circulation information storage area (not shown in the drawings) of the measured time storage area 1031.

The CPU 101 causes the feed pump 7 to operate (Step S81). The CPU 101 turns on the running lamp 24 on the operation panel 20. The feed pump 7 supplies the ink from inside the ink tank 2 to the input end 41 of the three-way switching valve 4 through the upstream tube 31 and the downstream tube 32. At this time, the three-way switching valve 4 forms the second flow path. The ink that flows into the three-way switching valve 4 is discharged from the second output end 43 and returns to the ink tank 2 through the third connecting tube 6.

The timer 113 starts to measure the time (Step S82). The CPU 101 stores the time that the timer 113 has measured, as a measured time t6, in the measured time storage area 1031 of the RAM 103. The measured time t6 corresponds to the time that has elapsed since the feed pump 7 started operating. The CPU 101 determines whether the measured time t6 has reached a specified time T6 (Step S83). In the circulation operation, the feed pump 7 operates intermittently. The specified time T6 is stored in the specified value storage area 1022 of the ROM 102. The specified time T6 is the time that the feed pump 7 operates in a single cycle. In a case where the measured time t6 has reached the specified time T6 (Step S83), the CPU 101 temporarily stops the operation of the feed pump 7 (Step S85).

The number of operation cycles N is stored in the number of operation cycles storage area 1032 of the RAM 103. The CPU 101 adds 1 to the number of operation cycles N that is stored in the RAM 103 (Step S89). The CPU 101 determines whether the number of operation cycles N has reached a maximum number of operation cycles M (Step S91). The maximum number of operation cycles M is stored in the specified value storage area 1022 of the ROM 102. The maximum number of operation cycles M is the maximum number of cycles of the circulation operation of the feed pump 7 in the circulation processing. In a case where the CPU 101 has determined that the number of operation cycles N has not reached the maximum number of operation cycles M (NO at Step S91), the CPU 101 continues the circulation processing.

Specifically, the CPU 101 determines whether the measured time t6 has reached a specified time T7 (Step S87). The specified time T7 is stored in the specified value storage area 1022 of the ROM 102. The specified time T7 is a sum of the time during which the feed pump 7 operates and the time during which the feed pump 7 is stopped in a single operation cycle. In a case where the measured time t6 has not reached the specified time T7 (NO at Step S87), the CPU 101 repeats the processing at Step S87. The feed pump 7 continues to be in a state in which its operation is stopped for as long as the CPU 101 repeats the processing at Step S87. In a ease where the measured time t6 has reached the specified time T7 (YES at Step S87), the CPU 101 returns to the processing at Step S80. The CPU 101 then repeats the processing that is described above.

In a case where the CPU 101 has determined that the number of operation cycles N has reached the maximum number of operation cycles M (YES at Step S91), the CPU 101 sets to zero (0) the number of operation cycles N that is stored in the number of operation cycles storage area 1032 (Step S93). The CPU 101 turns off the running lamp 24 on the operation panel 20. The circulation processing is terminated.

In the circulation processing, as described above, the ink refilling device 1 performs the circulation operation intermittently, with the time during which the feed pump 7 operates being defined as T6, the time during which the feed pump 7 is stopped being defined as (T7-T6), and the maximum number of cycles of the circulation processing being defined as M. When the feed pump 7 is operating, the ink flows through the upstream tube 31, the downstream tube 32, and the third connecting tube 6 and returns to the ink tank 2. Thus, the ink within the upstream tube 31, the downstream tube 32, the third connecting tube 6, and the ink tank 2 changes from a static state to a churned state. Because the ink flows intermittently, a turbulence in the ink inside the ink tank 2, the upstream tube 31, the downstream tube 32, and the third connecting tube 6 becomes greater. The ink refilling device 1 is therefore able to improve the dispersion of the ink pigment. The ink pigment is dispersed every time that the ink refilling device 1 performs the circulation processing, even in a case where the ink that is stored in the ink tank 2 contains an ink pigment has a high specific gravity. The dispersion of the ink pigment throughout the ink can be maintained in a good state. The ink refilling device 1 performs the circulation processing every time the specified time T1 elapses. Even if the operator does not intentionally perform an operation, the ink refilling device 1 is able to reliably disperse the ink pigment throughout the ink.

In the ink refill and circulation processing that is shown in FIG. 8, after the circulation processing (Step S23), the CPU 101 sets to zero (0) the measured time t1 that is stored in the measured time storage area 1031 of the RAM 103 (Step S25). The timer 113 starts to measure the time again (Step S27). The CPU 101 stores the time that the timer 113 has measured, as the measured time t1, in the measured time storage area 1031 of the RAM 103. The CPU 101 determines whether the power supply is off (Step S19). In a case where the operator has pressed the power button 29 on the operation panel 20 and turned off the power supply (YES at Step S19), the CPU 101 terminates the ink refill and circulation processing. In a case where the power supply is not off (NO at Step S19), the CPU 101 returns to the processing at Step S15 and repeats the processing that was described previously.

As explained above, according to the ink refilling device 1 of the present embodiment, the ink flows from inside the ink tank 2, through the upstream tube 31 and the downstream tube 32, and into the input end 41 of the three-way switching valve 4. In a case where the three-way switching valve 4 has formed the first flow path, the ink that has flowed into the input end 41 is discharged from the first output end 42. The discharged ink flows through the second connecting tube 5 and into the ink cartridge 50. In a case where the three-way switching valve 4 has formed the second flow path, the ink that has flowed into the input end 41 is discharged from the second output end 43. The discharged ink returns to the ink tank 2 through the third connecting tube 6. In other words, the three-way switching valve 4 is able to switch between the first flow path and the second flow path. By switching the flow paths, the ink refilling device 1 is able to selectively perform the refill operation that refills the ink cartridge 50 with the ink from inside the ink tank 2 and the circulation operation that returns the ink from inside the ink tank 2 back to the ink tank 2.

Through the process of the circulation operation, the ink that is stored in the ink tank 2 is put into a churned state. The ink refilling device 1 is thus able to disperse the ink pigment throughout the ink through the process of the circulation operation, even in a case where the ink that is stored in the ink tank 2 contains an ink pigment that has a high specific gravity. Therefore, during the refill operation, the ink refilling device 1 is able to supply the ink to the ink cartridge 50 with the concentration and dispersion of the ink pigment in a stable state.

The ink refilling device 1 is provided with the bypass tube 8. The bypass tube 8 branches from the central portion of the downstream tube 32 and connects to the central portion of the third connecting tube 6. The bypass tube 8 is provided with the pressure control valve 9 closer to the end of the bypass tube 8 that is connected to the downstream tube 32. The pressure control valve 9 opens in a case where the pressure that is not less than a specified pressure is applied from the downstream tube 32 side. The pressure control valve 9 closes in a case where the pressure that is applied from the downstream tube 32 side is less than the specified pressure. In other words, in a case where the internal pressure in the downstream tube 32 is greater than the internal pressure in the third connecting tube 6 by at least the specified pressure, the pressure control valve 9 opens, such that the bypass tube 8 connects the downstream tube 32 and the third connecting tube 6. This allows a portion of the ink that is flowing through the downstream tube 32 to flow to the third connecting tube 6 through the bypass tube 8 instead of passing through the three-way switching valve 4.

For example, in a case where an obstructed state (a state in which the ink does not flow smoothly) exists in the vicinity of the three-way switching valve 4, the pressure of the ink that is flowing through the downstream tube 32 increases. In such a case, the pressure control valve 9 opens, such that the bypass tube 8 connects the downstream tube 32 and the third connecting tube 6. The bypass tube 8 allows a portion of the ink that is flowing through the downstream tube 32 to flow to the third connecting tube 6 without passing through the three-way switching valve 4. Therefore, the ink pressure in the three-way switching valve 4 and the supply portion 51 does not become greater than the specified pressure. In other words, even in a case where an obstructed state exists in the ink flow path, an internal pressure that is greater than the specified pressure is not imposed on the three-way switching valve 4 and the supply portion 51. The ink refilling device 1 is therefore able to prevent the ink from leaking and spattering from a connecting portion between the three-way switching valve 4 and the ink supply tube and from the supply portion 51.

The present invention is not limited to the ink refilling device 1 according to the embodiment that is described above, and various types of modifications are possible. For example, the ink tank sensor 116 in above-described the embodiment is a weight sensor. Alternatively, the ink tank sensor 116 may be a capacitance sensor. The capacitance sensor may be provided in a lower portion of the ink tank 2. The capacitance sensor may also be provided on an upstream side in a direction that the ink flows in the upstream tube 31. The capacitance sensor can detect whether the amount of the ink that is remaining inside the ink tank 2 is at least the specified amount based on an electrostatic capacitance of the ink tank 2, or the upstream tube 31.

For example, in a case where the capacitance sensor is provided in a lower portion of the ink tank 2, if the amount of the ink that is remaining inside the ink tank 2 is at least the specified amount, the capacitance sensor detects the electrostatic capacitance of the ink. If the amount of the remaining ink is less than the specified amount, detects the electrostatic capacitance of air. The electrostatic capacitances of the ink and air are different. Therefore, the capacitance sensor is able to detect that the surface of the ink inside the ink tank 2 has dropped below the level of the capacitance sensor. The capacitance sensor is thus able to detect that the amount of the ink that is remaining inside the ink tank 2 is less than the specified amount. The capacitance sensor exhibits high detection accuracy and high reproducibility even if it is used repeatedly. Therefore, the capacitance sensor can reliably prevent air from flowing into the ink cartridge 50.

Figure 9:
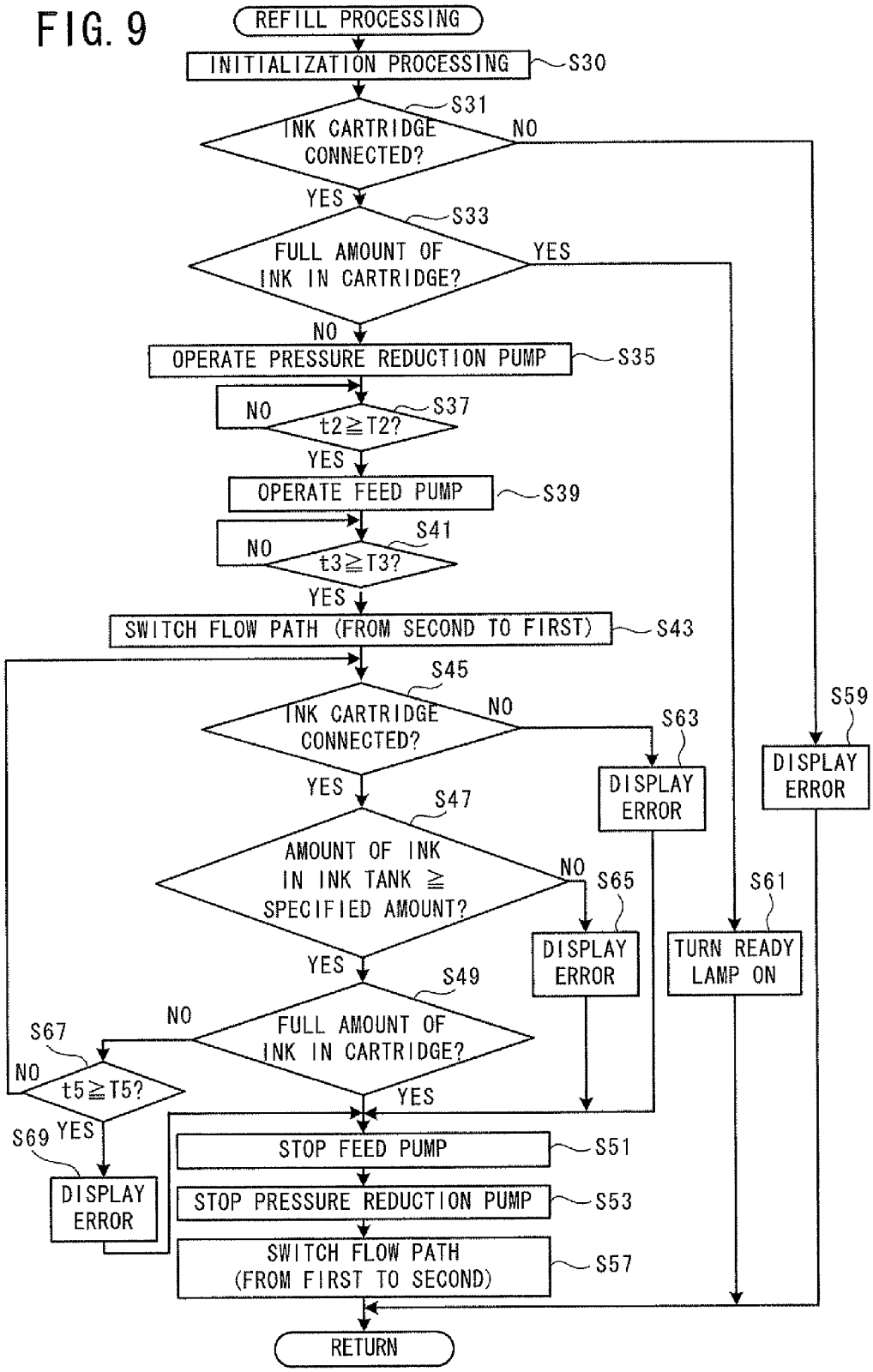
FIG. 9 is a flowchart of refill processing.
Figure 10:
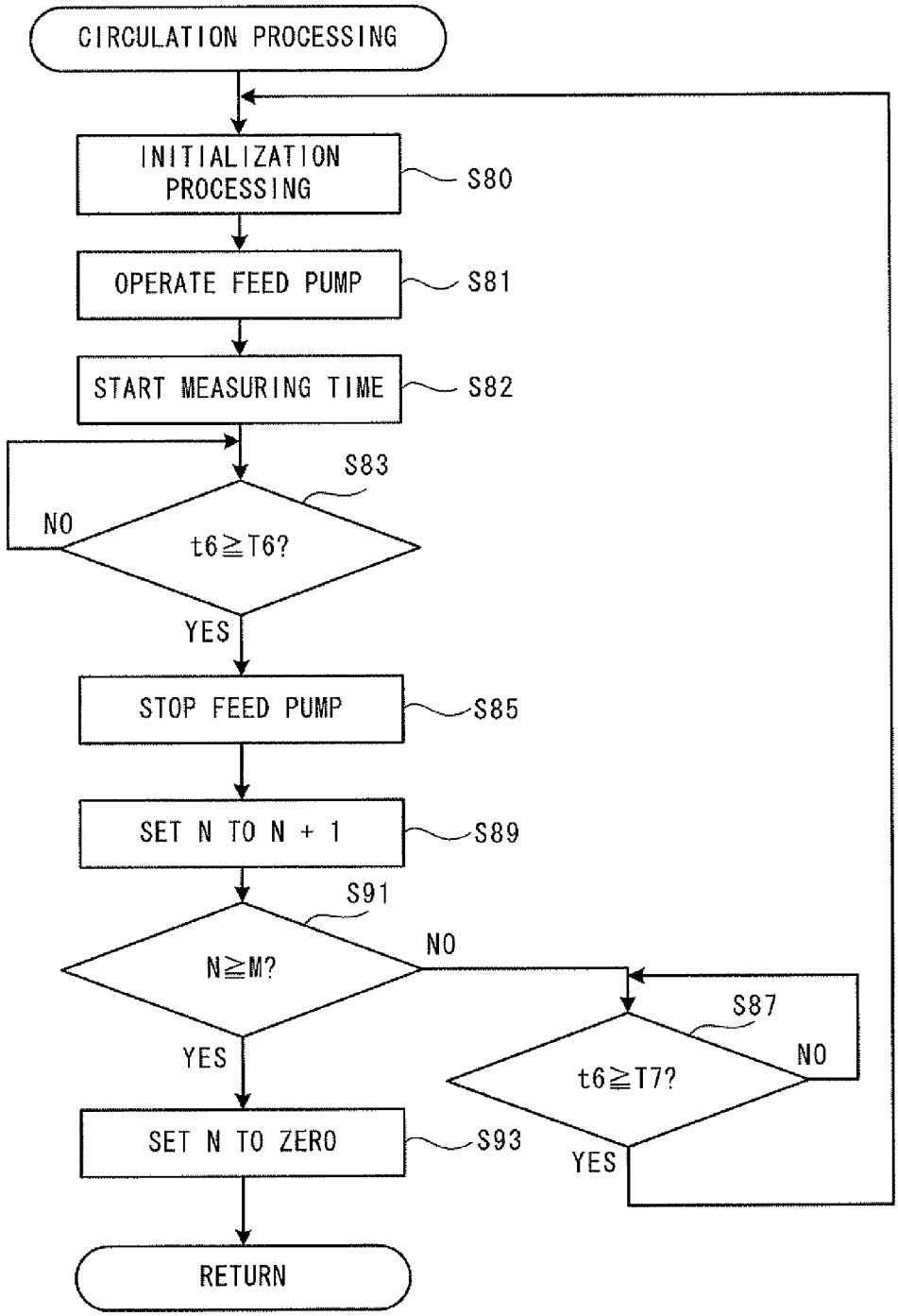
FIG. 10 is a flowchart of circulation processing.

In the embodiment that is described above, in the refill processing that is shown in FIG. 9, in a case where the CPU 101 has determined that the amount of the ink in the ink cartridge 50 is the full amount, that is, that the amount of the ink in the ink cartridge 50 is equal to or more than the specified amount (YES at Step S49), the CPU 101 stops the operation of the feed pump 7 (Step S51). Alternatively, the CPU 101 may only switch the flow path in the three-way switching valve 4 from the first flow path to the second flow path, without stopping the operation of the feed pump 7. In such a case, the supplying of the ink to the ink cartridge 50 can also be stopped.

Figure 11:
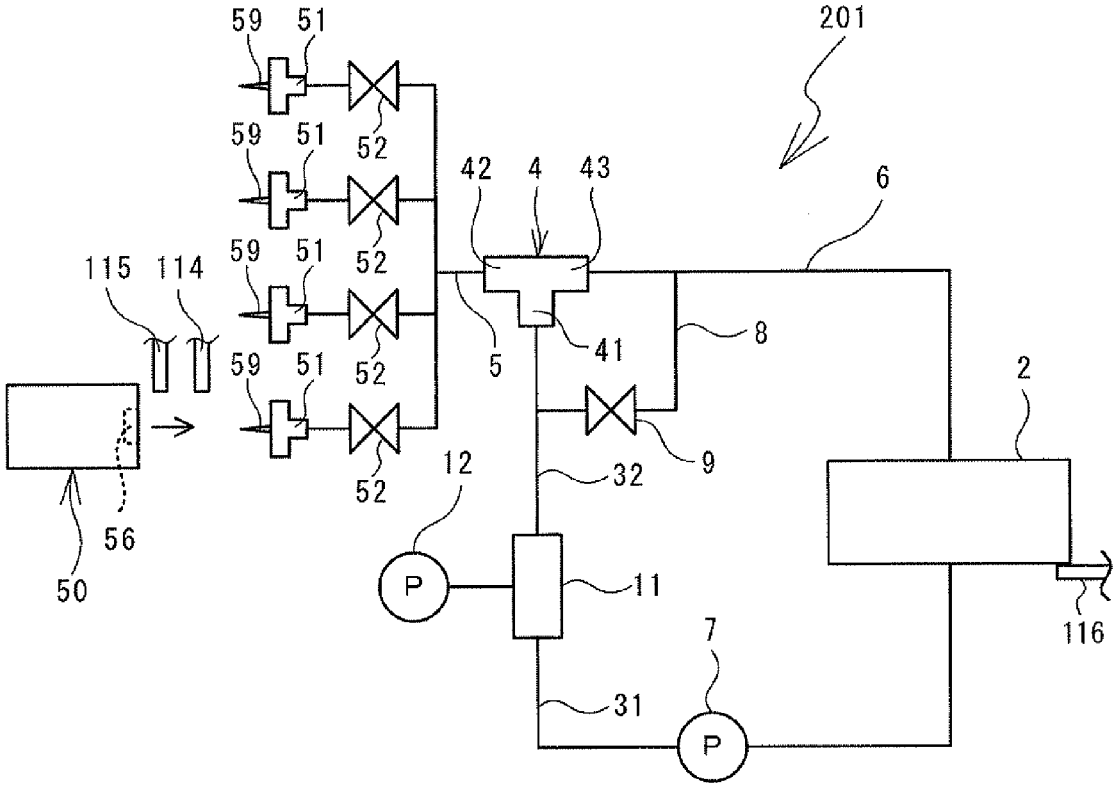
FIG. 11 is a configuration diagram of an ink refilling device 201.

The second connecting tube 5 may also divide into a plurality of branches, as in an ink filling device 201 that is shown in FIG. 11. A valve 52 and the supply portion 51 may also be provided in each of the branches of the second connecting tube 5, in a downstream portion in a direction in which the ink flows. The cartridge sensor 114 is provided in the vicinity of each of the supply portions 51. In a case where the cartridge sensor 114 has detected that the ink cartridge 50 is connected and the ink amount sensor 115 has detected that the amount of the ink inside the ink cartridge 50 is not the full amount, the corresponding valve 52 is opened. The ink filling device 201 is able to supply the ink to a plurality of the ink cartridges 50 at one time. Note that in this modified example, a plurality of the ink cartridges 50, the cartridge sensors 114, and the ink amount sensors 115 are provided, but only one of each is shown in FIG. 11.

The ink refilling device 1 in the embodiment that is described above, as its method for removing the dissolved gas from the ink, causes the ink to flow through the interior of each of the hollow fibers 14 and reduces the pressure on the outside of each of the hollow fibers 14. The method for removing the dissolved gas from the ink is not limited to this method. Alternatively, a filter for trapping foreign matters may be provided within the flow path.

Figure 12:
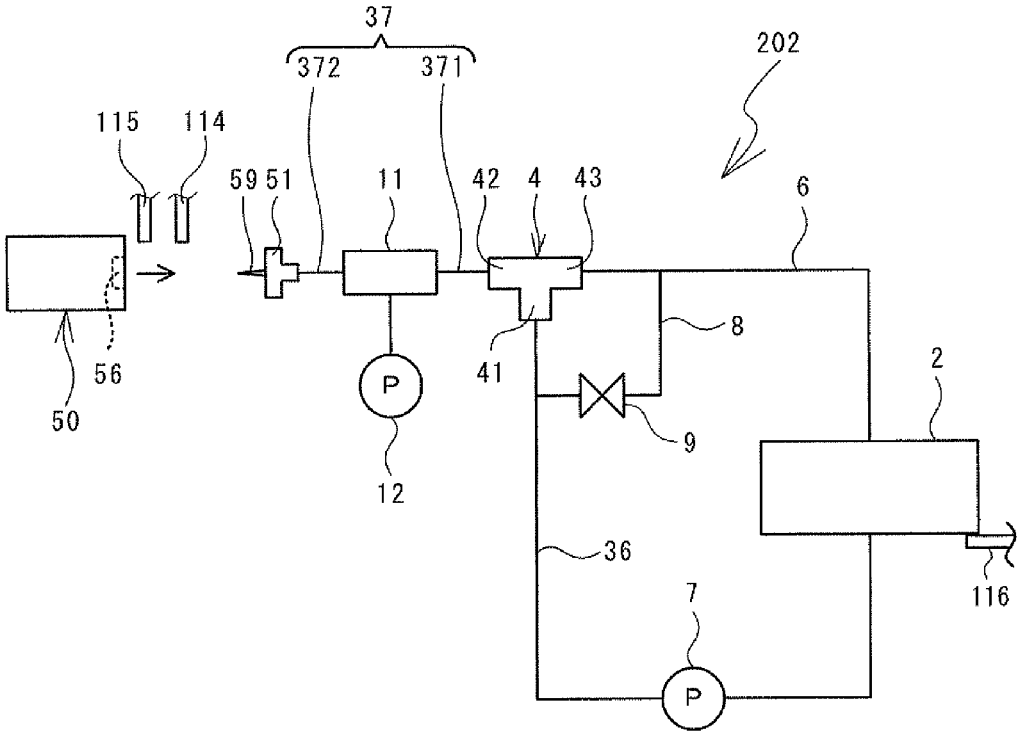
FIG. 12 is a configuration diagram of an ink refilling device 202.

The degassing module 11 may be provided along a connecting tube that has one end connected to the first output end 42 of the three-way switching valve 4 and the other end connected to the supply portion 51. An ink filling device 202 that is an example of this modification will be explained with reference to FIG. 12. The ink filling device 202 includes a first connecting tube 36 instead of the upstream tube 31 and the downstream tube 32 of the ink refilling device 1 shown in FIG. 1. One end of the first connecting tube 36 is connected to the ink tank 2. The other end of the first connecting tube 36 is connected to the input end 41 of the three-way switching valve 4. The feed pump 7 is provided along the first connecting tube 36.

Unlike in the ink refilling device 1 shown in FIG. 1, the degassing module 11 is not provided along the first connecting tube 36. The degassing module 11 is provided along a second connecting tube 37 instead. The second connecting tube 37 includes an upstream tube 371 and a downstream tube 372. One end of the upstream tube 371 is connected to the first output end 42 of the three-way switching valve 4. The other end of the upstream tube 371 is connected to the inlet of the degassing module 11. One end of the downstream tube 372 is connected to the outlet of the degassing module 11. The other end of the downstream tube 372 is connected to the supply portion 51. The degassing module 11 removes the gas from the ink before the ink flows into the supply portion 51.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An ink refilling device for refilling an ink cartridge of an inkjet printer with ink, the ink refilling device comprising:

a supply portion that is adapted to be connected to the ink cartridge and supply the ink to the ink cartridge when the ink cartridge is refilled with the ink;

an ink tank that is adapted to store the ink;

a first connecting tube, one end of which is connected to the ink tank;

a three-way switching valve that includes an input end, a first output end and a second output end, and that is adapted to switch between a first flow path and a second flow path, the input end being connected to the other end of the first connecting tube that is at an opposite end of the first connecting tube from the one end, the first flow path running from the input end to the first output end, and the second flow path running from the input end to the second output end;

a second connecting tube, one end of which is connected to the first output end of the three-way switching valve and the other end of which is connected to the supply portion;

a third connecting tube, one end of which is connected to the second output end of the three-way switching valve and the other end of which is connected to the ink tank;

a feed pump that is provided along the first connecting tube and that is adapted to feed the ink from inside the ink tank to the input end of the three-way switching valve;

a refill command portion that issues a command to refill the ink cartridge with the ink:

an ink amount detection portion that is adapted to detect an amount of the ink inside the ink cartridge;

a degassing portion that is provided along the first connecting tube and that is adapted to remove gas that is dissolved in the ink;

a degassing start control portion that causes the degassing portion to start a degassing operation in a case where the refill command portion has issued the command to refill the ink cartridge with the ink;

a feed start control portion that causes the feed pump to start a feed operation in a case where the refill command portion has issued the command to refill the ink cartridge with the ink; and a control portion that:

in a case where the refill command portion has issued the command to refill the ink cartridge with the ink, switches the three-way switching valve to the first flow path;

in a case where the amount of the ink that is detected by the ink amount detection portion is equal to or more than a specified amount, switches the three-way switching valve to the second flow path or stops an operation of the feed pump; and switches the three-way switching valve to the first flow path in a case where a first specified time has elapsed since the degassing operation was started and a second specified time has elapsed since the feed operation was started.

2. The ink refilling device according to claim 1, wherein the degassing portion includes:

a hollow fiber bundle that is a bundle of hollow fibers, through interiors of which the ink can flow, and a pressure reduction portion that is adapted to reduce a pressure on outsides of the hollow fibers in the hollow fiber bundle.

3. The ink refilling device according to claim 2, wherein:

the degassing portion includes a case that contains the hollow fiber bundle and that is sealed off from an outside air, and the pressure reduction portion is adapted to reduce the pressure on the outsides of the hollow fibers in the hollow fiber bundle inside the case.

4. The ink refilling device according to claim 1, wherein:

the degassing portion includes a hollow fiber bundle that is a bundle of hollow fibers, through interiors of which the ink flows, and a pressure reduction portion that is adapted to reduce a pressure on outsides of the hollow fibers in the hollow fiber bundle, the degassing start control portion, in a case where the refill command portion has issued the command to refill the ink cartridge with the ink, causes the pressure reduction portion to operate to start the degassing operation, the feed start control portion, in a case where a third specified time has elapsed since an operation of the pressure reduction portion was started, causes the feed pump to start the feed operation, and the control portion switches the three-way switching valve to the first flow path in a case where the first specified time has elapsed since the operation of the pressure reduction portion was started and the second specified time has elapsed since the feed operation was started.

5. The ink refilling device according to claim 1, further comprising:

a remaining ink amount detection portion that is adapted to detect a remaining amount of the ink that is inside the ink tank; and a prohibiting portion that prohibits the operation of the feed pump in a case where the remaining amount of the ink that has been detected by the remaining ink amount detection portion is less than a specified amount.

6. The ink refilling device according to claim 5, wherein:

the remaining ink amount detection portion is a capacitance sensor.

7. The ink refilling device according to claim 1, further comprising:

a bypass tube that connects to a central portion of the first connecting tube and to a central portion of the third connecting tube; and a pressure control valve that is provided along the bypass tube, that closes in a case where a pressure that is applied from a first connecting tube side is less than a specified pressure, and that opens in a case where a pressure that is applied from the first connecting tube side is not less than the specified pressure.

* * * * *